United States Patent [19]

Gillette

[11] 4,166,260

[45] Aug. 28, 1979

[54] CIRCUIT BREAKER ACCESSORY ASSEMBLY

[75] Inventor: Stephen F. Gillette, Hartford, Conn.

[73] Assignee: General Electric Company, New York, N.Y.

[21] Appl. No.: 891,236

[22] Filed: Mar. 29, 1978

[51] Int. Cl.[2] ..... H01H 73/06; H01H 73/08

[52] U.S. Cl. ..... 335/20; 335/202

[58] Field of Search ..... 335/20, 8, 9, 10, 202; 200/333, 338

[56] References Cited

U.S. PATENT DOCUMENTS

| | | | |
|---|---|---|---|
| 2,938,980 | 5/1960 | Jencks | 335/20 |
| 3,215,801 | 11/1965 | Nimylowycz | 335/20 |
| 3,815,058 | 6/1974 | Stetsuk | 335/20 |
| 4,097,831 | 6/1978 | Jencks et al. | 335/20 |

*Primary Examiner*—Harold Broome

*Attorney, Agent, or Firm*—Robert A. Cahill; Walter C. Bernkopf; Philip L. Schlamp

[57] ABSTRACT

A circuit breaker accessory assembly, such as a shunt trip solenoid, is affixed to an insulative mounting member which is interchangeably mounted in place of a conventional interphase barrier within the breaker molded case. The trip solenoid plunger is operatively coupled with the breaker common trip bar, while the actuator for a normally closed switch wired in the solenoid energization circuit is positionally mounted for actuation by movement of a breaker contact arm to its open circuit position, thereby opening the switch.

10 Claims, 6 Drawing Figures

CIRCUIT BREAKER ACCESSORY ASSEMBLY

BACKGROUND OF THE INVENTION

Users of industrial molded case circuit breakers are increasingly demanding that additional functions over and above traditional overcurrent circuit protection be incorporated in the circuit breakers. To meet this demand, manufacturers have developed a line of accessory devices, such as shunt trips, undervoltage releases, bell alarms, lockouts, etc., for incorporation in their circuit breakers. While these accessory devices are relatively simple in design, it is often quite difficult to package these devices within the breaker case, principally because of space limitations and assembly difficulties. This is particularly so in the smaller breaker frame sizes. As a consequence, it is not uncommon to find industrial molded case circuit breakers being assembled on virtually a shop order basis when they are to be equipped with one or more accessory functions.

It is accordingly an object of the present invention to provide improved mounting provisions for physically and operationally incorporating an accessory function within the molded case of a multi-pole circuit breaker.

An additional object is to provide improved accessory mounting provisions of the above character, wherein an accessory device can be readily mounted within a circuit breaker case in a simple and expeditious manner.

Yet another object is to provide an improved accessory assembly which does not require special or additional fastening elements in mounting the accessory assembly within a breaker case.

A further object of the present invention is to provide a circuit breaker accessory assembly capable of being retrofitted in an "off the shelf" molded case circuit breaker in a simple and economical fashion.

Other objects of the invention will in part be obvious and in part appear hereinafter.

SUMMARY OF THE INVENTION

In accordance with the present invention, a circuit breaker accessory device is affixed to an insulative mounting member which is structured to be interchangeably mounted within a molded circuit breaker case in place of a conventional, removable interphase barrier. The mounting member thus serves not only to mount the accessory device, but also to afford the requisite breaker interphase isolation normally provided by the removed barrier. The mounting member is captured by lateral edge engaging grooves provided in an interphase partition molded into the base of the breaker case in the same manner as the normal interphase barrier and is clamped in place by the cover of the breaker case.

In the specifically disclosed embodiment of the invention, the accessory device is illustrated as a shunt trip solenoid. A suitable fastener, such as a screw, engages the solenoid frame to assemble the shunt trip solenoid to the mounting member. The resulting assembly is then mounted within the breaker case with the solenoid plunger operatively coupled with the breaker common trip bar. This assembly also includes a normally closed switch mounted to the solenoid frame and wired in series with one of the solenoid coil leads. An actuator arm for this switch is mounted to the assembly so as to be positioned for engagement by a breaker contact arm as it moves to its open circuit position, thereby opening the switch and the solenoid energization circuit.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed desscription taken in conjunction with the accompanying drawings, in which.

Like reference numerals refer to corresponding parts throughout the several views of the drawings.

DETAILED DESCRIPTION

Figure 1:
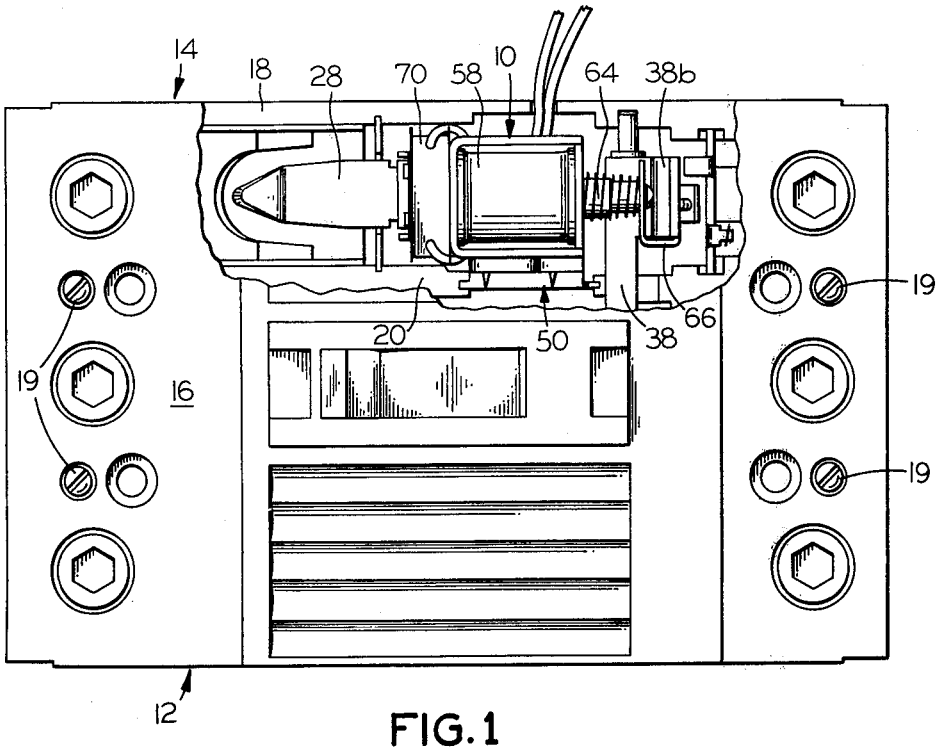
FIG. 1 is a plan view, partially broken away, of a three-pole molded case circuit breaker incorporating the accessory assembly of the present invention.

The accessory assembly of the present invention, generally indicated at 10, is illustrated in FIG. 1 as being incorporated in a three-pole electric circuit breaker, generally indicated at 12, which may be of the construction disclosed in U.S. Pat. No. 3,309,479. The circuit breaker includes a molded insulative case, generally indicated at 14, comprising a cover 16 and a base 18 secured together by a plurality of screws 19. Sidewalls of the base and cover, together with a pair of intermediate partitions upstanding from the base (one seen at 20), define three separate, side-by-side breaker pole chambers. The cover is provided with depending intermediate partitions, one seen at 22 in FIGS. 3 and 4, which cooperate with the base intermediate partitions 20 in substantially totally partitioning the pole chambers to provide effective interphase isolation.

Figure 2:
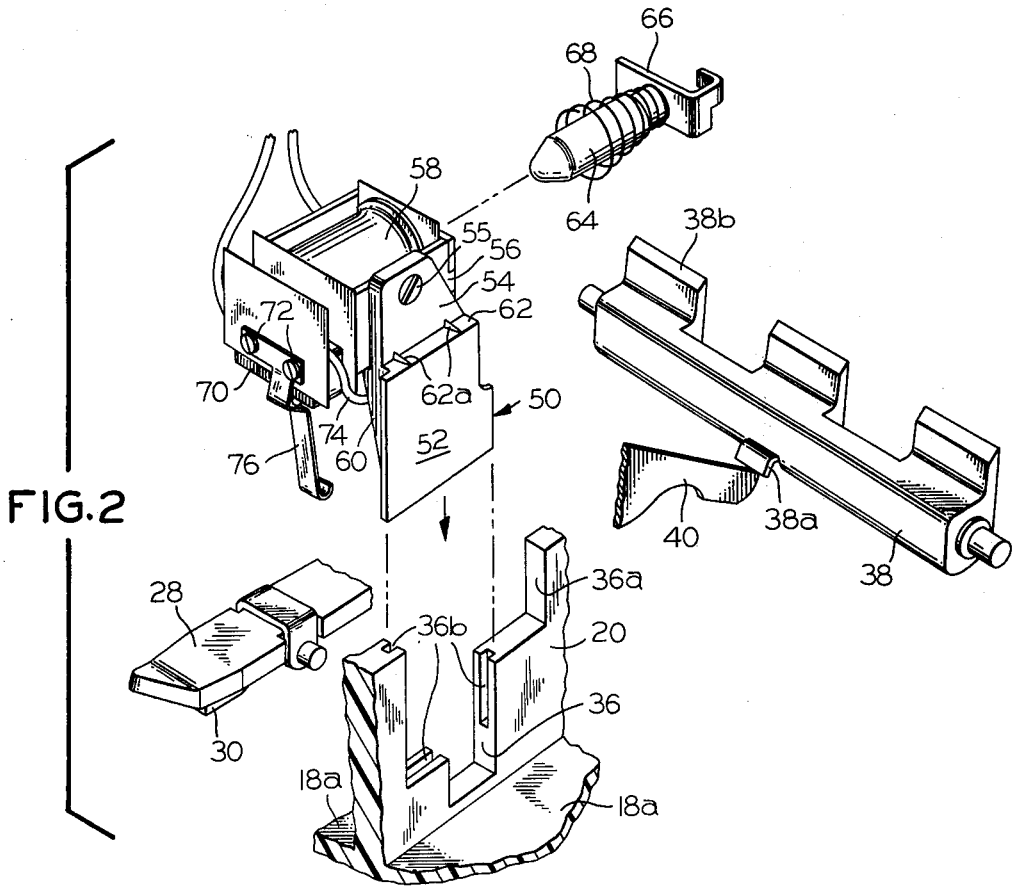
FIG. 2 is an exploded, fragmentary perspective view illustrating the manner in which the accessory assembly is mounted within the circuit breaker of FIG. 1.
Figure 5:
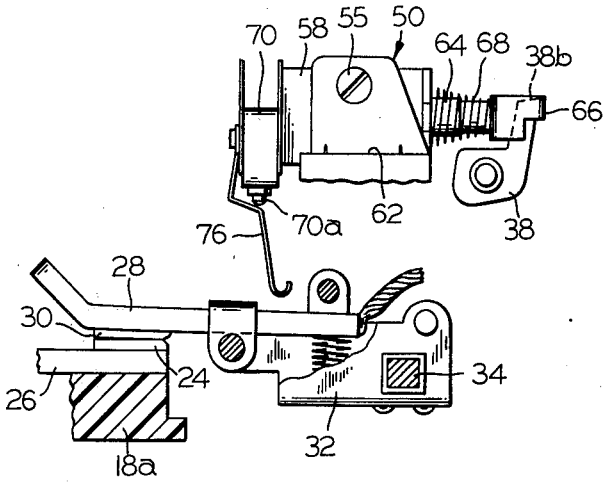
FIG. 5 is a fragmentary, side elevational view of the mounted accessory assembly of FIG. 2, illustrating its quiescent condition.
Figure 6:
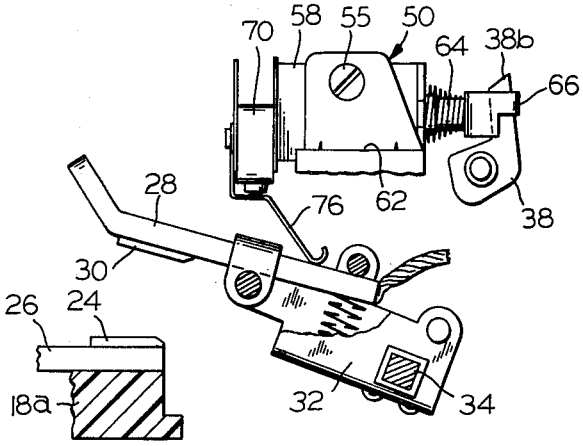
FIG. 6 is a fragmentary, side elevational view of the accessory assembly of FIG. 2, illustrated in its operated condition.

Each pole chamber accommodates a stationary contact 24 affixed to a terminal strap 26 anchored to the floor **18*a* of base 18, all as seen in FIGS. 5 and 6. Operating in each pole chamber is an arm 28 which mounts a movable contact 30. Each arm is mounted by a pivotal carrier 32 for movement of its movable contact 30 into and out of engagement with stationary contact 24. Movement of the arms is motivated in unison by an operating mechanism (not shown) accommodated in the center pole chamber and acting via a cross bar 34 tying the carriers 32 in the three-pole chambers together. To accommodate the assembly and transverse extension of cross bar 34 through the three-pole chambers, the intermediate partitions 20 upstanding from base 18 are provided with an interruption 36, best seen in FIG. 2. Also spanning the three-pole chambers is a rotatably mounted common trip bar 38 which carries a centrally located latch 38*a* for normally latchably engaging a trigger 40 to sustain the breaker operating mechanism in its reset or untripped condition. The common trip bar also carries a series of upstanding flanges 38***b* for separate disposition in each of the breaker pole chambers. These flanges provide flat surfaces against which conventional overcurrent responsive, thermal-magnetic trip elements can act to rotate the trip bar, thereby releasing the trigger 40 to trip the breaker in response to a current flow of overcurrent proportions through any one of the breaker poles. As seen in FIG. 2, the interruptions 36 in the intermediate base partitions 20 are relieved, as indicated at 36*a*, so as to accommodate the transverse extension of common trip bar 38.

To substantially restore the loss of interphase isolation caused by the interruption 36 in each intermediate base partitions 20, a planar, insulative barrier is slideably received in grooves 36*b* formed in the edges of the base partitions bounding the interruption. These barriers are then captured in place by the depending cover partitions 22 when cover 16 is secured in closure relation with base 18. It is a signal feature of the present invention to replace one of these interphase barriers with a uniquely structured, insulative member, generally indicated at 50, which, in addition to serving as an interphase barrier, accommodates the mounting of accessory assembly 10 in a requisite operational position. Thus to physically adapt circuit breaker 12 with the accessorial function provided by accessory assembly 10, one has only to slide mounting member 50 down into grooves 36*b* in place of the normal interphase barrier.

By way of example, accessory assembly 10 is disclosed as comprising the requisite components for providing a shunt trip function. However, it will be appreciated that mounting member can be readily modified to mount a variety of components pursuant to providing other accessorial functions, such as undervoltage release, auxiliary switching, etc. As seen in the drawings, mounting member 50 is provided with a panel-like section 52 of equivalent size to the normal interphase barrier so as to provide equivalent interphase isolation when slid down into grooves 36*b* formed in base partition 20. Upstanding in laterally offset fashion from panel section 52 is a flange 54 having a hole for accommodating a screw 55 whose shank is threaded into a tapped bore provided in the frame 56 of a shunt trip solenoid 58. To provide structural integrity, several triangular-shaped ribs 60, are molded into mounting member 50 between panel section 52 and flange 54. Preferably, these ribs extend laterally beyond flange 54 so as to provide ledges 60*a* (FIGS. 3 and 4) on which the lower edge of solenoid frame 56 rests. These ledges, together with screw 55, serve to securely mount shunt trip solenoid 58 to mounting member 50 in anti-turn fashion.

Figure 3:
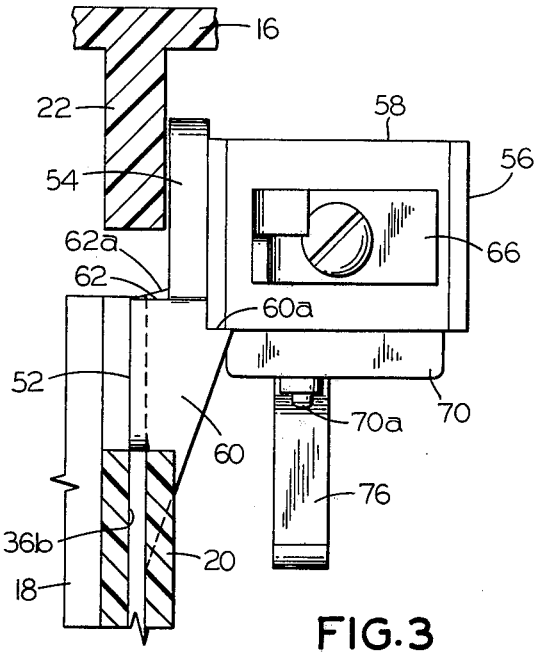
FIG. 3 is a front elevational view, partially in section, of the mounted accessory assembly of FIG. 2 with the cover of the breaker case displaced from its case closure position.
Figure 4:
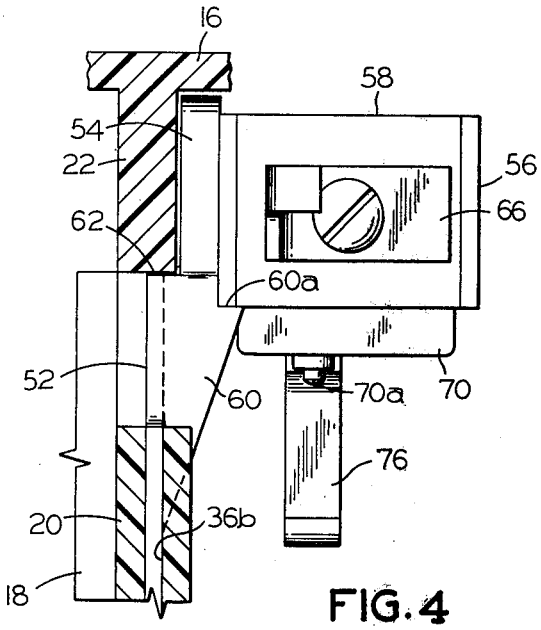
FIG. 4 is a front elevational view, partially in section, of the mounted accessory assembly of FIG. 2 with the case cover secured in its case closure position.

The lateral offset relation of flange 54 to panel section 52 creates a shoulder 62 against which the depending intermediate cover partition 22 bears when cover 16 is secured in closure relation with base 18 (FIGS. 3 and 4). To accommodate manufacturing tolerances, small triangular-shaped webs 62*a* are molded into shoulder 62 in positions to be engaged by cover partition 22. These webs plastically deform in response to the press of cover partition 22 as the cover screws 19 are tightened down (FIG. 4), thereby insuring positive clamping pressure on mounting member 50 when the cover 16 is tightly secured to base 18.

Solenoid 58 is equipped with a plunger 64 having affixed to its outer end a clip 66 structured to partially embrace the particular flange 38*b* of common trip bar 38 situated in the same pole chamber with accessory assembly 10. It is seen from FIGS. 5 and 6 that upon energization of solenoid 58, its plunger is attracted or pulled in, causing common trip bar 38 to be rotated in a direction to disengage its latch 38*a* from trigger 40, and the breaker trips. A compression spring 68 normally biases plunger 64 to its extended position, thereby permitting the trip bar latch 38*a* to engage trigger 40. This spring is sufficiently light so as not to impede the action of any of the thermal-magnetic tripping elements on the common trip bar.

It is common practice to wire the trip solenoid coil through a normally closed switch which is opened in response to the opening of the breaker to interrupt the solenoid energization circuit and thus preclude needless solenoid energization. Under these circumstances, the shunt trip solenoid can be inexpensively designed for only very limited duty. To this end, a normally closed switch 70, best seen in FIGS. 2, 5 and 6, is mounted to the solenoid frame 56 by a pair of small screws 72. One lead 74 is wired through this switch to one side of the solenoid coil. Screws 72 also serve to mount a resilient actuator arm 76 which depends down into the pole chamber to a termination poised in closely spaced relation to the movable contact arm 28 therein while it is in its closed circuit position (FIG. 5). When the breaker is manually opened or tripped open, either by the shunt trip solenoid or by the thermal-magnetic tripping elements, contact arm 28 is swung upwardly into deflecting engagement with actuator arm 76. This deflection causes arm 76 to engage an actuator button 70*a*, transferring switch 70 to its open condition. It will be noted that switch 70 is sustained in its open condition as long as the breaker contacts are open to thus inhibit needless energization of the shunt trip solenoid.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. In a multipole circuit breaker having a molded case consisting of a base and a cover having complimenting intermediate partitions serving to provide interphase isolation between adjacent pole chambers, at least the intermediate base partitions being provided with interruptions accommodating the transverse extension of a movable contact arm uniting cross bar, the edges of the base partitions bounding the interruptions being provided with grooves for slidingly receiving insulative barriers in non-interfering relation with the cross bar to substantially restore interphase isolation between adjacent pole chambers, an accessory assembly comprising, in combination:

A. an insulative mounting member having
   (1) a panel-like section of equivalent size to the interphase barrier for sliding receipt in lieu thereof in the grooves of one base partition interruption, and
   (2) an integral upstanding mounting flange;

B. an accessory apparatus; and

C. fastening means for securing said accessory apparatus to said mounting flange in operative position within one of the breaker pole chambers.

2. The accessory assembly defined in claim 1, wherein said mounting member is structured to accommodate engagement by the complimenting one of the cover intermediate partitions, whereby said mounting member is clamped in place when the cover is secured in case closure relation with the base.

3. The accessory assembly defined in claim 1, wherein said mounting flange is laterally offset from said panel section to provide a shoulder accommodating engagement by the complimenting one of the cover intermediate partitions, whereby said mounting member is clamped in place when the cover is secured in case closure relation with the base.

4. The accessory assembly defined in claim 3, wherein said mounting member further includes webs molded on said shoulder, said webs being sized so as to readily plastically deform in response to clamping engagement by the complimenting intermediate cover partition.

5. The accessory assembly defined in claim 3, wherein said accessory apparatus includes a solenoid having a plunger operatively coupled with a breaker common trip bar.

6. The accessory assembly defined in claim 5, wherein said mounting member includes internal reinforcing ribs interconnecting said panel section and mounting flange on the opposite side from said shoulder.

7. The accessory assembly defined in claim 6, wherein said ribs extend laterally beyond said mounting flange to provide ledges on which a portion of said solenoid rests.

8. The accessory assembly defined in claim 7, wherein said solenoid is a shunt trip solenoid, said accessory apparatus further including a normally closed switch wired into an electrical lead into one side of the activating coil for said shunt trip solenoid and an actuating arm positioned to be deflected by a breaker movable contact arm in moving to its open circuit position, said deflected actuating arm actuating said switch to its open condition.

9. The accessory assembly defined in claim 8, wherein said mounting member further includes webs molded on said shoulder, said webs being sized so as to readily plastically deform in response to clamping engagement by the complimenting intermediate cover partition.

10. The accessory assembly defined in claim 9, wherein said fastening means is a single screw.

* * * * *